United States Patent [19]

Yamazaki

[11] Patent Number: 4,799,732

[45] Date of Patent: Jan. 24, 1989

[54] CHAIR SEAT INCLINING AND MOVING DEVICE

[75] Inventor: Kouichi Yamazaki, Yokohama, Japan

[73] Assignee: Okamura Corporation, Kanagawa, Japan

[21] Appl. No.: 105,558

[22] Filed: Oct. 6, 1987

[51] Int. Cl.[4] ..... A47C 3/00

[52] U.S. Cl. ..... 297/300; 297/312; 297/458; 297/460

[58] Field of Search ..... 297/300, 353, 285, 458, 297/460, 312, 284, 297; 5/120

[56] References Cited

U.S. PATENT DOCUMENTS

| | | | |
|---|---|---|---|
| 2,667,210 | 1/1954 | Eames | 297/297 |
| 3,565,482 | 2/1971 | Blodee | 297/284 |
| 3,877,750 | 4/1975 | Sholpp | 297/284 |
| 4,418,958 | 12/1983 | Watkin | 297/458 |

FOREIGN PATENT DOCUMENTS

| | | | |
|---|---|---|---|
| 7804978 | 11/1978 | Netherlands | 297/300 |

*Primary Examiner*—James T. McCall

*Attorney, Agent, or Firm*—Rosen, Dainow & Jacobs

[57] ABSTRACT

The seat of a chair comprises stepped engaging portions provided at the rear portion of the seat plate and stepped engaging portions provided at the lower portion of the reclining back seat are fitted with stepped engaging portions provided at the front portion and the upper portion of a connecting plate bending with a gentle obtuse angle, respectively, opposing sides of the stepped engaging portions of the seat plate and the stepped engaging portions of the connecting plate are pivotally fixed by connecting members which energize the connecting plate upwardly, and opposing sides of the stepped engaging portions of the connecting plate and the stepped engaging portions of the reclining back seat are pivotally fixed by connecting members which energize the reclining back seat forwardly.

4 Claims, 1 Drawing Sheet

CHAIR SEAT INCLINING AND MOVING DEVICE

BACKGROUND OF THE INVENTION

1. Field of the Invention

The present invention relates to a chair seat inclining and moving device for inclining and moving a seat plate and a reclining back seat of a chair so that an occupant can be naturally settled down on the chair comfortably.

2. Background of the Invention

Many types of chairs have been proposed already, among them there are many types of chairs, for example, such types of a chair in which a seat plate is inclined together with a reclining back seat, a chair which inclines the whole of the reclining back seat, a chair in which the upper part of the reclining back seat is made to incline, etc. Particularly, as the chair in which the upper portion of the reclining back seat is adapted to incline, there is an example disclosed in the Japanese Utility Model Laid-Open Publication No. 61-23854. However, construction of the chair of this type is as follows, that is, the reclining back seat is separated into two parts, the upper portion and the lower portion, and adapted, to incline only the upper portion thereof. Accordingly, when the upper portion is inclined, the bending portion of the reclining back seat projects forwardly, accordingly, the waist part of a sitting person is pushed forwardly so as to warp the backbone of the person. Thus, to sit on this type of the chair it is uncomfortable because of unnatural posture being forcedly taken.

The invention aims to solve the above described disadvantages of the conventional chairs by the following excellent construction, that is, the seat of the chair according to the present invention is constructed as follows; stepped engaging portions provided at the rear portion of the seat plate and stepped engaging portions provided at the lower portion of the reclining back seat are fitted with stepped engaging portions provided at the front portion and the upper portion of a connecting plate bending with a gentle obtuse angle, especially opposing sides of the stepped engaging portions of the seat plate and the stepped engaging portions of the connecting plate are pivotally fixed by connecting members which energize the connecting plate upwardly, and opposing sides of the stepped engaging portions of the connecting plate and the stepped engaging portions of the reclining back seat are pivotally fixed by connecting members which energize the reclining back seat forwardly.

SUMMARY OF THE INVENTION

It is an object of the present invention to provide a chair provided with a connecting plate between the seat plate and the reclining back seat so as to be able to bend at two portions and incliningly and swingingly move.

It is another object to provide a chair having small forward projection in the reclining back seat to give comfortable feeling to the sitting person.

Other and further objects, features of the present invention will appear more fully from the following description.

In the present invention the connecting plate is provided between the seat plate and the reclining back seat, and can be bent at two positions, so that a forwardly projecting portion resulting in the bending is small, and since the seat plate and the connecting plate, and the connecting plate and the reclining back seat are pivotally connected with each other at both sides of the seat plate and the reclining back seat, it is possible to form a recessed portion on which the waist part of a sitting person can be settled down by bending the central part of the bending portion may be projected rearwardly. Accordingly, the sitting person can feel quite comfortable by naturally settling down on the center part of the chair.

DETAILED DESCRIPTION OF THE PREFERRED EMBODIMENT

Figure 1:
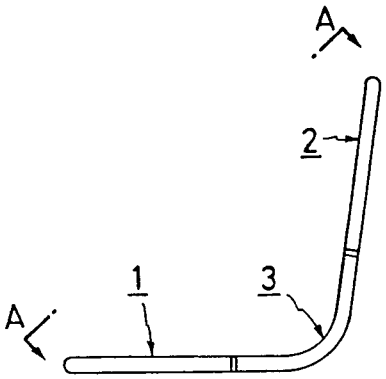
FIG. 1 is a side view of a chair to which the present invention is applied.
Figure 2:
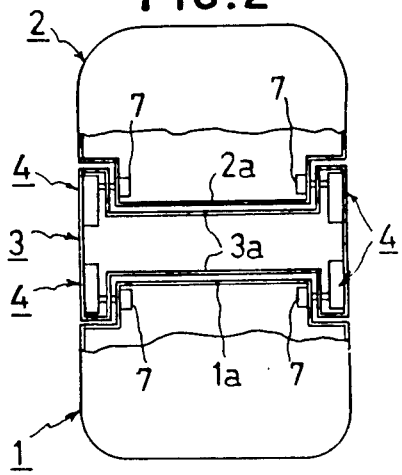
FIG. 2 is a partially broken view seen in A—A line direction in FIG. 1.

FIGS. 1 and 2 show a seat of a chair to which the present invention is applied, the seat comprises a seating plate (1), a reclining back seat (2) and a connecting plate (3) bending gently with an obtuse angle being provided between the seat plate (1) and the reclining back seat (2). At each of the lower portions of the seat plate (1) and the reclining back seat (2) there are formed convex portions (1*a*) and (2*a*), respectively, and they are fitted with both concave portions (3*a*), respectively, and each of sides of the both concave portions (3*a*) opposing to respective those of the both convex portions (1*a*) and (2*a*) are rotatably fitted with each other by connecting members (4) as will be described hereunder.

Figure 3:
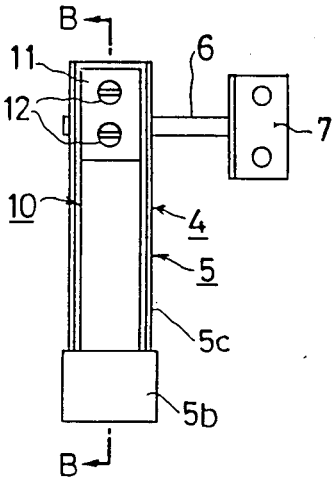
FIG. 3 is an elevation view of a connecting device.
Figure 4:
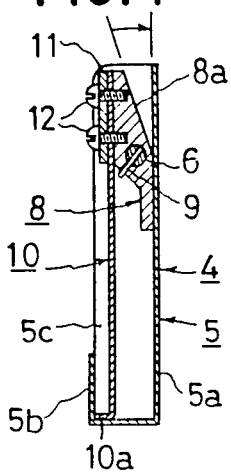
FIG. 4 is a sectional view cut along B—B line in FIG. 3.

In FIGS. 3 and 4 there are shown the connecting members (4). In these figures at the lower end of a central piece (5*a*) of a U groove-shaped case (5) which is shown in the figures as directing to the up and down directions (hereinafter, when there are any description regarding directions of each of parts of the connecting device, refer to the directions shown in these figures), there is provided a stopper (5*b*) which at first projects to the front and then rises to close the lower end and the lower part of the front side of the case (5).

On the upper portion of the case (5) there is pivotally provided a pivot means or connecting rod (6) which penetrates both side pieces (5*c*), and at the right end of the connecting rod (6) a fitting plate (7) is secured. At an appropriate portion of the connecting axis (6) positioned in the inside of the case (5) there are secured rotatable metallic members (8) with knock pins (9).

The lower portion of the rear side of each of the rotatable metallic members (8) is in usual time, overlapped with the central piece (5*a*) of the case (5), and at the upper portion of the rear side of each of the rotatable metallic members (8) there is formed an inclining plane (8*a*) which incliningly directs to the upper front direction. Further, a plate spring (10) is hangingly provided at the front side of the rotatable metallic member (8) by means of a pressing plate (11) and screws (12). At the lower end of the plate spring (10) a forwardly bending piece (10*a*) is provided, and the tip of the end contacts with the stopper (5*b*) of the case (5).

As shown in FIG. 2, the afore-mentioned connecting members (4) are secured to the upper portions of the both right and the left sides of the concave portions (3*a*) of the connecting plate (3), and the connecting axis (6) penetrates opposing side walls of the connecting plate (3) and the reclining back seat (2).

Thus, the fitting plate (7) is secured to the inside of the reclining back seat (2). The connecting plate (3) and the seat plate (1) are also pivotally fitted with each other by the connecting members (4) which are disposed inversely in the direction as those used for the afore-described case.

Figure 5:
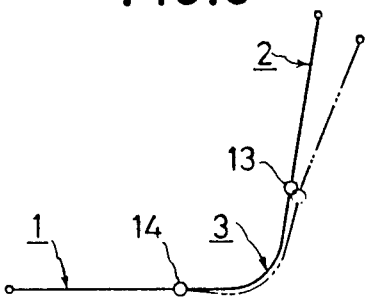
FIG. 5 is diagrammatic views showing conditions of a seat of the chair according to the present invention, when someone sits there, i.e., when a back seat of the chair is being inclined, and when no person sits there.

In the seat of the above described construction, when a person sits on the seat plate (1) and leans on the reclining back seat (2), as schematically shown in FIG. 5, the reclining back seat (2) and the connecting plate (3) inclininglyand swingingly move lower in the rear direction at pivotally connecting portions (13) and (14) of the seat plate (1) and the connecting plate (3) and the reclining back seat (2) and the connecting plate (3), until the inclining plane (8*a*) of each of the rotatable metallic members (8) contacts with the central piece (5*a*) of the case (5), so that size or range of forwardly projecting part of the upper pivotally connecting portion (13) is made considerably smaller than those of conventional seats of chairs. In other words at the two pivotally connecting portions (13) and (14), a bending angle between the seat plate (1) and the reclining back seat (2) is shared by two parts, so that at each of the pivotally connecting portions bending angles are made smaller, which gives feelings that no forwardly projecting portion is there on the reclining back seat. Further, the side shape of the reclining back seat (2) is quite similar with curved shape of the backbone of the human being, and if the vicinity of the upper and the lower connecting portions are somewhat dented, when an occupant sits down on the chair, the waist part of the person is naturally rested on the central part of the chair, so that a long time can even be spent in comfortably on the chair.

Further, since the pivotally connecting portions (13) and (14) are provided in the both sides of the seat, the upper convex portion (2*a*) and the concave portion (3*a*) can be bent rearwardly, and the lower convex portion (1*a*) and the concave portion (3*a*) can be bent in the lower direction.

As described above, accordingly, in the seat of the present invention, even if an occupant sits on the seat and leans on the reclining back seat, by means of the two pivotally connecting portions each of magnitudes of the inclination and movement of the reclining back seat and the seat plate can be shared with each other, so that the forward projecting portion at the pivotally connecting portion of the reclining back seat and the connecting plate is considerably small, and further the side sectional shape of the reclining back seat is resembles the curve of the backbone of a human being. In addition, if the vicinity of the connecting portions of the up and down parts of the seat are a little recessed, the waist of the sitting person can be naturally settled down at the center of the seat of the chair, so that a man can even sit a long time thereon comfortably.

Although the invention has been described in its preferred form with a certain degree of particularity, it is understood that the present disclosure of the preferred form can be changed in the detailed construction and the combination and arrangement of parts may be resorted to without departing from the spirit and scope of the invention hereinafter claimed.

What is claimed is:

1. A chair seat inclining and moving device comprising:

a seat plate provided with stepped engaging portions at the rear part thereof;

a reclining seat back providing stepped engaging portions at the lower part thereof;

a connecting plate curved upwardly with a gentle obtuse angle and the front part of which is gently directs upwardly, the front portion of the front part and the upper portion of the rear part of said connecting plate having stepped engaging portions which fitted with the stepped engaging portions of said seat plate and the reclining back seat, respectively;

connecting means for pivotally fitting opposing sides of said stepped engaging portions of said seat plate and the stepped engaging portions of said connecting plate with one another, said connecting means allowing said connecting plate to move upwardly; and connecting means for pivotally fitting opposing sides of said stepped engaging portions of said connecting plate and said stepped engaging portions of said reclining back seat with one another, said connecting means allowing said reclining back seat to move forwardly.

2. A chair seat inclining and moving device according to claim 1, wherein said stepped engaging portions of said seat plate are convex shape and those of said connecting plate are concaved ones which are adapted to pivotally fixed with the corresponding convex shaped engaging portions of said connecting plate.

3. A chair seat inclining and moving device according to claim 1, wherein said stepped engaging portions of said reclining back seat are convex shaped engaging portions which are pivotally fixed with the corresponding concave shaped engaging portions of said connecting plate.

4. A chair seat inclining and moving device according to claim 1, wherein said connecting means comprises a connecting axis penetrating both sides pieces of a case, attaching plates secured to the right end of said connecting axis, rotatable metallic members having forwardly directing inclining plane secured to the inside of said case and a plate spring.

* * * * *